US009257016B1

(12) United States Patent
Palacio

(10) Patent No.: US 9,257,016 B1
(45) Date of Patent: Feb. 9, 2016

(54) POKER GAME PLAYER TRACKING DEVICE

(71) Applicant: Jose L. Palacio, Moreno Valley, CA (US)

(72) Inventor: Jose L. Palacio, Moreno Valley, CA (US)

( * ) Notice: Subject to any disclaimer, the term of this patent is extended or adjusted under 35 U.S.C. 154(b) by 151 days.

(21) Appl. No.: 14/172,971

(22) Filed: Feb. 5, 2014

(51) Int. Cl.
*A63F 3/00* (2006.01)
*G07F 17/32* (2006.01)
*A63F 1/18* (2006.01)

(52) U.S. Cl.
CPC ..... *G07F 17/3293* (2013.01); *A63F 1/18* (2013.01)

(58) Field of Classification Search
CPC ..... A63F 1/18; A63F 3/00176; A63F 2003/00725
See application file for complete search history.

(56) References Cited

U.S. PATENT DOCUMENTS

| | | | |
|---|---|---|---|
| 3,810,627 | A | 5/1974 | Levy |
| 4,614,342 | A | 9/1986 | Takashima |
| 4,814,589 | A | 3/1989 | Storch et al. |
| 5,648,752 | A | 7/1997 | Alfrey |
| 5,669,817 | A | 9/1997 | Tarantino |
| 6,165,069 | A | 12/2000 | Sines et al. |
| 6,299,531 | B1 | 10/2001 | Bommarito |
| 6,755,420 | B2 | 6/2004 | Colton |
| D548,801 | S | 8/2007 | Groswirt |
| 7,255,642 | B2 | 8/2007 | Sines et al. |

*Primary Examiner* — Jay Liddle
*Assistant Examiner* — Alex F. R. P. Rada, II
(74) *Attorney, Agent, or Firm* — Law Office of Michael O'Brien

(57) ABSTRACT

A poker game player tracking device for tracking status of multiple players to facilitate efficient continuation of game play. The device includes a panel having a top surface. Each of a plurality of status indicators is positioned on the top surface of the panel. Each status indicator is associated with a specific condition relevant to playing poker. The status indicators are grouped into arrays of status indicators to indicate information about a specific player during a poker game. Each of a plurality of status markers is coupled to the panel. Each status marker is positioned to selectively cover an associated one of the status indicators.

13 Claims, 3 Drawing Sheets

POKER GAME PLAYER TRACKING DEVICE

BACKGROUND OF THE DISCLOSURE

Field of the Disclosure

The disclosure relates to game tracking devices and more particularly pertains to a new game tracking device for tracking status of multiple players to facilitate efficient continuation of game play.

SUMMARY OF THE DISCLOSURE

An embodiment of the disclosure meets the needs presented above by generally comprising a panel having a top surface. Each of a plurality of status indicators is positioned on the top surface of the panel. Each status indicator is associated with a specific condition relevant to playing poker. The status indicators are grouped into arrays of status indicators to indicate information about a specific player during a poker game. Each of a plurality of status markers is coupled to the panel. Each status marker is positioned to selectively cover an associated one of the status indicators.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
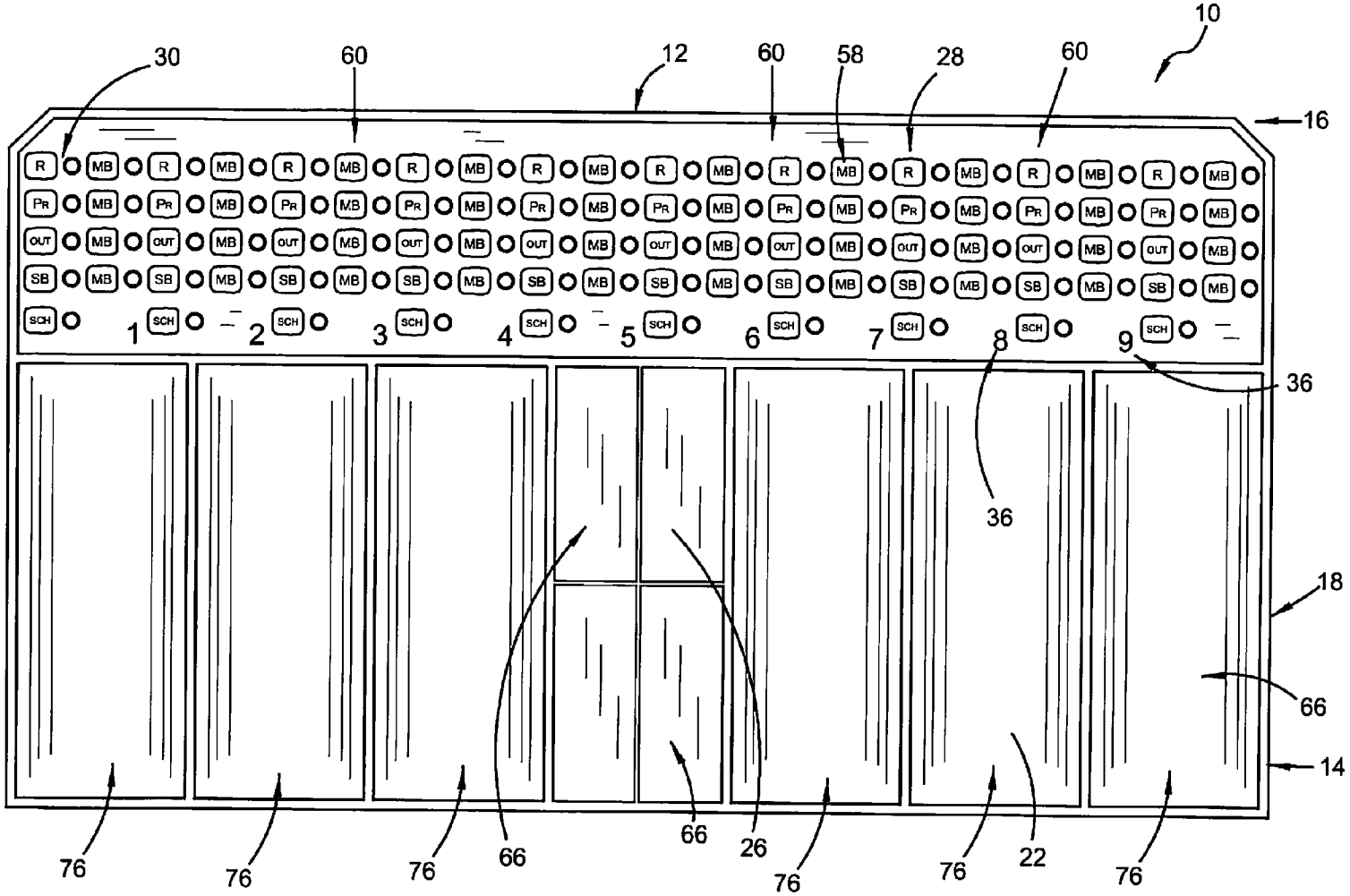
FIG. 1 is a top view of a poker game player tracking device according to an embodiment of the disclosure.
Figure 3:
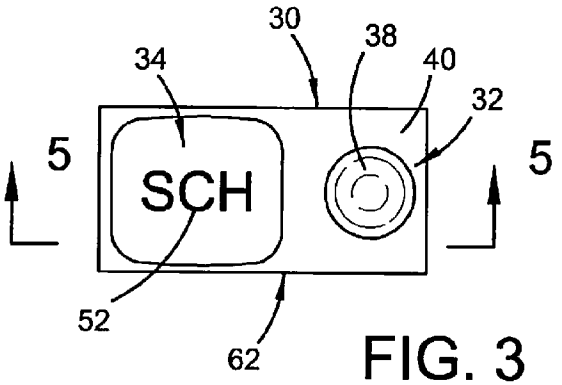
FIG. 3 is a detailed top view of an embodiment of the disclosure.
Figure 4:
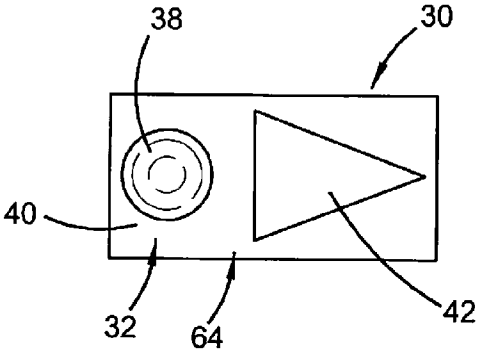
FIG. 4 is a detailed top view of an embodiment of the disclosure.
Figure 2:
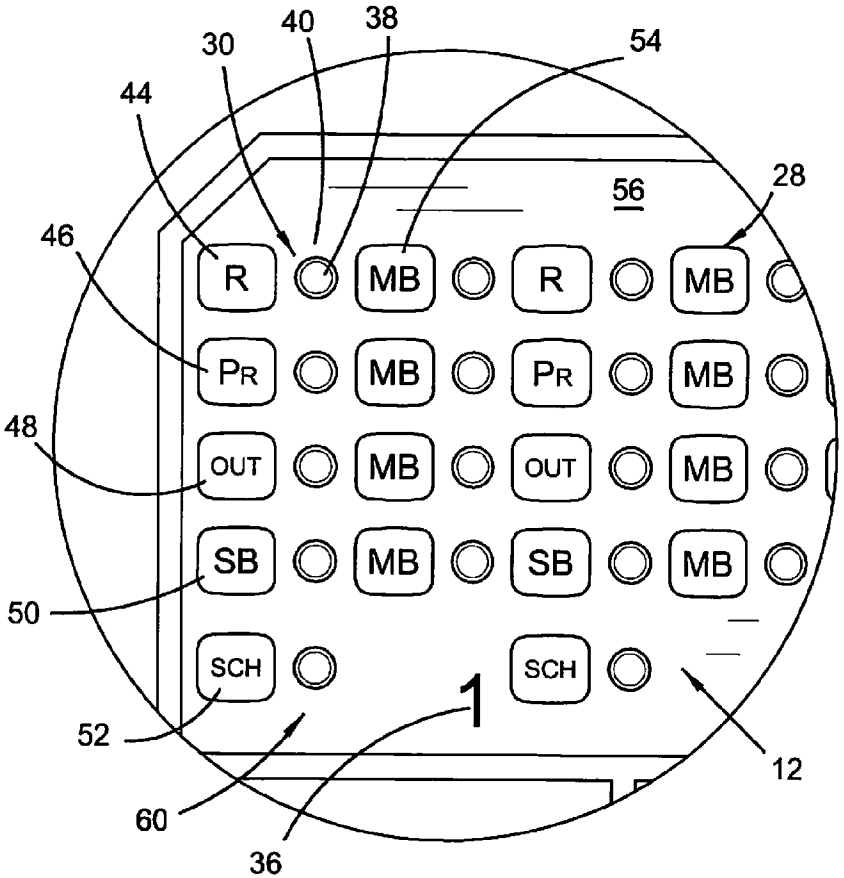
FIG. 2 is a detailed top view of an embodiment of the disclosure.
Figure 5:
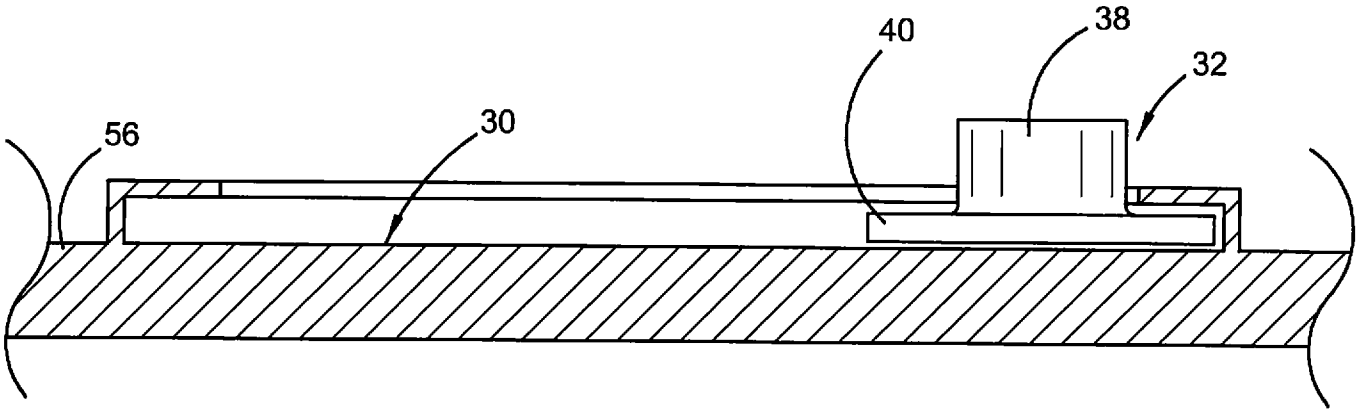
FIG. 5 is a cross-sectional view of an embodiment of the disclosure taken along line 5-5 of FIG. 3.

With reference now to the drawings, and in particular to FIGS. 1 through 5 thereof, a new game tracking device embodying the principles and concepts of an embodiment of the disclosure and generally designated by the reference numeral 10 will be described.

As best illustrated in FIGS. 1 through 5, the poker game player tracking device 10 generally comprises a panel 28 having a top surface 56. Each of a plurality of status indicators 30 is positioned on the top surface 56 of the panel 28. Each status indicator 30 may be indicia 58 positioned on the panel 28. The status indicators 30 are grouped into arrays 60 of status indicators 30 such that each array 60 is configured to indicate information about a specific player during a poker game. Each of a plurality of player identifiers 36 is positioned on the panel 28. Each player identifier 36 is positioned on the panel 28 proximate an associated array 60 of the status indicators 30. The player identifiers may be numerical as it is common to track poker players by numbered seat position. Exactly ten the arrays 60 of the status indicators 30 may be positioned on the panel 28 as this is a typical maximum number of players found in casino or tournament poker play. The number of arrays 60 may be different to correspond to variously sized gaming tables.

Each status indicator 30 is associated with a specific condition relevant to playing poker as described below. The status indicators 34 within each array 60 may comprise a reserved indicator, a player return indicator, an out indicator, a short buy indicator, a seat change indicator, and a missed blind indicator. The indicia 58 may include an "R" 44 to indicate a reserved seat being held for a player not yet at a poker table where the game is being played. The indicia may include a "PR" symbolic of the term player return indicating a seat where the player has left the table temporarily but is known to be returning. The indicia 58 may comprise an "OUT" 48 indicating the dealer is dealing the player out for any reason. The indicia 58 may comprise an "SB" 50 symbolic of a short buy indicating that a player has not yet met the minimum buy-in to participate in a particular game or tournament although the player is still playing amongst other players who have paid the full buy-in amount. The indicia 58 may include an "SCH" 52 symbolic of a seat change request to indicate a current player has priority for a particular seat if the seat becomes available. The indicia may further include an "MB" 54 symbolic of missed blind to indicate when a player has not participated in the game for a period of time and must pay in or make up for not having contributed the initial bets (known as blinds) before being allowed to continue playing. Other conditions or situations may be similarly tracked to allow dealers to keep track of situations including but not limited to warnings for abusive or unacceptable behavior or language, drinks ordered, supplemental buy-ins, or various other situations which a casino or dealer may wish to track.

Each of a plurality of status markers 34 is coupled to the panel 28. Each status marker 34 is positioned to selectively cover an associated one of the status indicators 30. Each status marker 34 may be a slider 32 slidably coupled to the panel 28. Each slider 32 is slidable between a first position 62 adjacent to the associated status indicator 30 and a second position 64 covering the associated status indicator 30. Each slider 32 may comprise a base portion 40 and a knob 38. The knob 38 extends from the base portion 40 to facilitate sliding of the slider 32 by a dealer. The base portion 40 is coupled to the panel 28 and slides between the first position 62 and the second position 64. It is also contemplated that the above manually operated sliders 32 could be replaced with a system incorporating lights activated by switches, buttons, or the like. A respective slider marker 42 may be provided adjacent to each status indicator 34 such that the slider marker 42 is exposed when the slider 32 is moved to cover the status marker 34.

The panel 28 may be incorporated into a tray body 12 either integrally or by insertion of the panel 28 into a separable container defining the tray body 12. The panel 28 is coupled to, supported or positioned in the tray body 12. The tray body 12 comprises a first end 16 and a second end 14 opposite the first end 16. The panel 28 is positioned adjacent to the first end 16 which is then typically positioned nearer the players at a poker table. The tray body 12 comprises a storage section 18 positioned between the second end 14 of the tray body 12 and the panel 28. The storage section 18 may comprise a plurality of storage areas 66. The storage areas may include a chip holding area 22 comprising a plurality of channels 76 of the type found in conventional casino chip trays wherein the chip holding area 22 is configured for holding a plurality of poker chips. The storage areas 66 may also include a card storage area 24 having a generally rectangular flat bottomed structure configured for holding one or more decks of cards. The storage areas 66 may also include a button storage area 26 similar in configuration to the channels 76 but sized as necessary to hold a plurality of buttons of the type currently used to assist in tracking information such as missed blinds, and the like as described above. While the device 10 generally obviates the need for such buttons, situations may arise in which having such buttons would be desirable.

In use, the device 10 is positioned on the poker table adjacent to the dealer, typically with the storage areas 66 positioned nearer the dealer to limit access to the poker chips, cards, or other stored items, by the players. The panel 28 may be visible to all players and observers around the poker table. As a game progresses the dealer selectively slides the status markers 34 as necessary to track the relevant conditions and situations relating to each player as desired. As it is not uncommon for poker games to last long periods of time, or some games may be substantially continuous with players coming and going, it is common to change dealers at a given poker table. The panel 28 provides a visual indication of the status of the game being played and the individual status of the players involved (typically by seat number) allowing dealers to be switched with minimal delay for verbal communication to prepare a new dealer to take over for a dealer leaving the poker table.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A poker game player tracking device comprising:

a panel having a top surface;

a plurality of status indicators positioned on said top surface of said panel, each said status indicator being associated with a specific condition relevant to playing poker, said status indicators being grouped into arrays of status indicators such that each array is configured to indicate information about a specific player during a poker game; and a plurality of status markers, each status marker being coupled to said panel, each status marker being positioned to selectively cover an associated one of said status indicators; each said status indicator being indicia positioned on said panel; and each said status marker being a slider slidably coupled to said panel, each said slider being slidable between a first position adjacent to said associated status indicator and a second position covering said associated status indicator.

2. The device of claim 1, further comprising each said slider comprising a base portion and a knob, said knob extending from said base portion, said base portion being coupled to said panel.

3. The device of claim 1, further comprising a plurality of player identifiers, each player identifier being positioned on said panel proximate an associated said array of said status indicators.

4. The device of claim 1, further comprising said status indicators within each said array comprising a reserved indicator, a player return indicator, an out indicator, a short buy indicator, a seat change indicator, and a missed blind indicator.

5. The device of claim 1, further comprising a tray body, said panel being coupled to and positioned in said tray body.

6. The device of claim 5, further comprising said tray body comprising a first end and a second end opposite said first end, said panel being positioned adjacent to said first end.

7. The device of claim 6, further comprising said tray body comprising a storage section positioned between said second end of said tray body and said panel, said storage section comprising a plurality of storage areas.

8. The device of claim 7, further comprising said storage areas comprising a chip holding area, said chip holding area comprising a plurality of channels wherein said chip holding area is configured for holding a plurality of poker chips.

9. The device of claim 7, further comprising said storage areas comprising a card storage area configured for holding a deck of cards.

10. The device of claim 7, further comprising said storage areas comprising a button storage area configured for holding a plurality of buttons.

11. The device of claim 1, further comprising exactly ten said arrays of said status indicators being positioned on said panel.

12. A poker game player tracking device comprising:

a panel having a top surface;

a plurality of status indicators positioned on said top surface of said panel; each said status indicator being indicia positioned on said panel, each said status indicator being associated with a specific condition relevant to playing poker, said status indicators being grouped into arrays of status indicators such that each array is configured to indicate information about a specific player during a poker game;

a plurality of status markers, each status marker being coupled to said panel, each status marker being positioned to selectively cover an associated one of said status indicators, each said status marker being a slider slidably coupled to said panel, each said slider being slidable between a first position adjacent to said associated status indicator and a second position covering said associated status indicator, each said slider comprising a base portion and a knob, said knob extending from said base portion, said base portion being coupled to said panel;

a plurality of player identifiers, each player identifier being positioned on said panel proximate an associated said array of said status indicators.

said status indicators within each said array comprising a reserved indicator, a player return indicator, an out indicator, a short buy indicator, a seat change indicator, and a missed blind indicator; and a tray body, said panel being coupled to and positioned in said tray body, said tray body comprising a first end and a second end opposite said first end, said panel being positioned adjacent to said first end, said tray body comprising a storage section positioned between said second end of said tray body and said panel, said storage section comprising a plurality of storage areas, said storage areas comprising a chip holding area, said chip holding area comprising a plurality of channels wherein said chip holding area is configured for holding a plurality of poker chips, said storage areas comprising a card storage area configured for holding a deck of cards, said storage areas comprising a button storage area configured for holding a plurality of buttons.

13. The device of claim 12, further comprising exactly ten said arrays of said status indicators being positioned on said panel.

* * * * *